United States Patent [19]

Kaveney, Jr.

[11] 4,363,231

[45] Dec. 14, 1982

[54] DOOR LOCK

[75] Inventor: John R. Kaveney, Jr., East Peoria, Ill.

[73] Assignee: Caterpillar Tractor Co., Peoria, Ill.

[21] Appl. No.: 262,062

[22] PCT Filed: Jul. 7, 1980

[86] PCT No.: PCT/US80/00854

§ 371 Date: Jul. 7, 1980

§ 102(e) Date: Jul. 7, 1980

[51] Int. Cl.[3] ..... E05B 55/04

[52] U.S. Cl. ..... 70/484; 70/92; 70/152; 70/489; 292/92; 292/DIG. 23

[58] Field of Search ..... 70/92, 145, 152, 210, 70/467, 470, 478, 479, 483–485, 489; 292/21, 92, DIG. 23, DIG. 65

[56] References Cited

U.S. PATENT DOCUMENTS

| | | | |
|---|---|---|---|
| 1,583,079 | 5/1926 | Lurie | 70/483 X |
| 1,895,594 | 1/1933 | Strandt | 70/210 X |
| 1,908,958 | 5/1933 | Coffron | 292/164 X |
| 2,089,146 | 8/1937 | Hurd | 70/152 |
| 2,682,763 | 7/1954 | Williams | 70/211 |
| 3,698,215 | 10/1972 | Truhon | 70/152 |
| 4,277,964 | 7/1981 | Crabb et al. | 292/DIG. 23 X |

FOREIGN PATENT DOCUMENTS

| | | | |
|---|---|---|---|
| 855069 | 5/1940 | France | 70/210 |

*Primary Examiner*—William E. Lyddane

*Attorney, Agent, or Firm*—Wegner, Stellman, McCord, Wood & Dalton

[57] ABSTRACT

A vehicle door lock (106) and latch (104) assembly is provided whereby a key may be used to lock the door (100) and to prevent rotation of the outside door handle (108). A lock handle (116) is provided inside the vehicle door (100) for overriding the key lock (110) to permit the inside and outside handles (114,108) to operate to open the door. Both the key lock (110) and the lock handle (116) when turned operate a linkage (172,168) which is connected to the locking cam (158) enabling the locking cam (158) to be moved between its locked and unlocked positions. Even with the lock handle (116) and the key lock (110) in the locked position, the inside handle (114) can be turned to move the locking cam (158) to the unlocked position and to open the door (100). The outside handle (108) can now be used to open the door also. The outside handle (108) can also be released for operation by turning the key in the key lock (110) to the unlocked position.

10 Claims, 5 Drawing Figures

DOOR LOCK

TECHNICAL FIELD

This invention relates to door locks and, more particularly, to a door lock having a lock release apparatus operative from the inside of the vehicle.

BACKGROUND ART

Most current cabs, for instance, on tractors for bulldozers and the like, are locked from the outside using a key. The locks are such that they cannot be unlocked or operated from inside the cab when locked.

There are some locks which are key locked on one side and have a mechanism on the other side for unlocking. For example, U.S. Pat. No. 2,682,763, issued to Williams on July 6, 1954, shows a garage door latch which is key locked from the outside but has a slide mechanism on the inside which can be actuated on the inside to release the latch. Also, U.S. Pat. No. 1,908,958, issued to Coffron on May 16, 1933, shows a door latch which can be released from the inside and can have the bolt disconnected from the outside handle so that the outside handle will turn without moving the bolt.

A door lock assembly which is known to have a key lock on the outside and a lever on the inside for operating the assembly is used in some heavy equipment cabs today. This assembly has a lock release lever which extends into the cab and may be manually pivoted back and forth between locked and unlocked positions. The lower body of the lever has a notch in which an ear may be received to lock the outside handle from turning and has a cam surface which causes the lever to pivot to an unlocked position when engaged by a shoulder while the inside handle is turned. However, the slot in the door through which the lever extends is relatively long and is only partially blocked by the lever, the remaining portion being open. Thus, dust and other particles are allowed to get into the lock assembly with a potentially deleterious effect thereon.

The present invention is directed to overcoming one or more of the problems as set forth above.

DISCLOSURE OF THE INVENTION

In one aspect of the present invention, a lock assembly is provided for a vehicle door and door latch structure. The lock assembly is operatively engaged to the latch structure for opening and closing the latch through the use of first and second handles extending from opposite sides of the door. The first handle has a lock ring which is coaxially aligned with a bellcrank and rotatable relative thereto, the bellcrank being attached to the second handle. The lock ring has spaced apart projections, one of which engages a locking plate when the plate is in its locked position, thereby preventing movement of the spaced apart projections and lock ring. The bellcrank may engage the locking plate to move it out of its locked position and is connected to the latch structure so as to operate the latch structure when the second handle is turned. The locking plate is connected by a linkage to a point whereby pivoting of one of the links around that point operates the linkage to move the locking plate between its unlocked and locked positions. The pivoting link is connected to a key lock which extends to the same side of the door as the first handle, permitting operation from that side of the door. The pivoting link is also connected to a third handle projecting from the same side of the door as the second handle, which third handle also operates the linkage to move the locking plate between its locked and unlocked positions.

This door lock enables a latch structure provided for vehicles and the like to be operative from the outside and from the inside. When the door lock is locked so that the latch structure may not be operated from the outside, the door lock can be opened in either of two ways from the inside. First, the third handle which operates the linkage may be turned to operate the linkage which, in turn, moves the locking plate to its unlocked position. Secondly, the second handle can be operated to turn the latch ring which, in turn, engages the locking plate to pivot it to its unlocked position. To lock the door lock from the inside, the third handle may be turned in the opposite direction to operate the linkage to move the locking plate to its locked position. Because the lock ring engages the locking plate when the locking plate is in its locked position, the first handle may not be turned when the door is locked. From the outside or first handle side of the door, it is necessary to use a key in the key lock which will, in turn, operate the linkage to move the locking plate to its unlocked position. With the locking plate in the unlocked position, the first handle may be turned, turning the lock ring and also the bellcrank to actuate the latch structure.

By providing a third handle which enables the door lock to be locked from inside the vehicle, the lock mechanism may be maintained in a virtual seal within the door panels. Unlike previous locks of this general structure, there are no exposed openings in the door panels through which particles may pass to get into the lock mechanism. This improved lock thus provides safety and security with a relatively simple structure and has a longer life and improved durability in comparison to similar type latches.

BEST MODE FOR CARRYING OUT THE INVENTION

Figure 1:
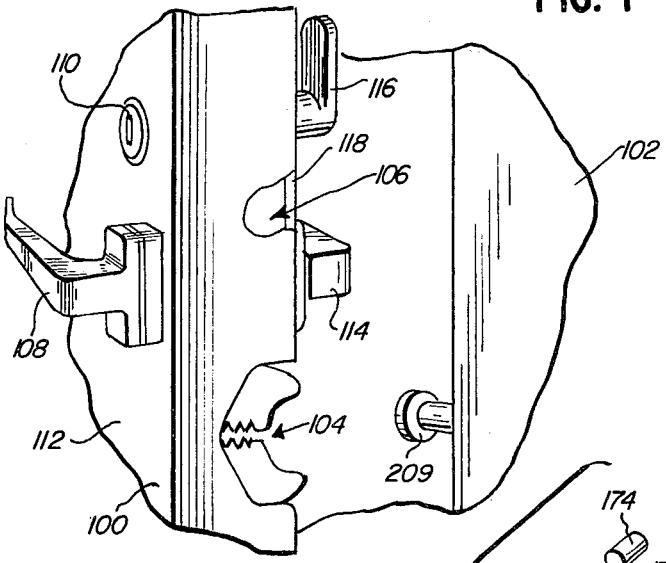
FIG. 1 is a partial perspective view of a door latch and door frame used with our improved lock mechanism.

A door 100 and door jamb 102 for an equipment cab having a latch 104 operated by the inventive door lock 106 are shown in FIG. 1. An outside handle 108 and key lock 110 extend from the outside door panel 112 and thus are accessible to persons outside the cab to actuate the lock 106 and latch 104 as hereinafter described. An inside door handle 114 and lock handle 116 extend through the inside panel 118 and may be turned by a person inside the cab to actuate the lock 106 and latch 104 as is also hereinafter described.

Figure 2:
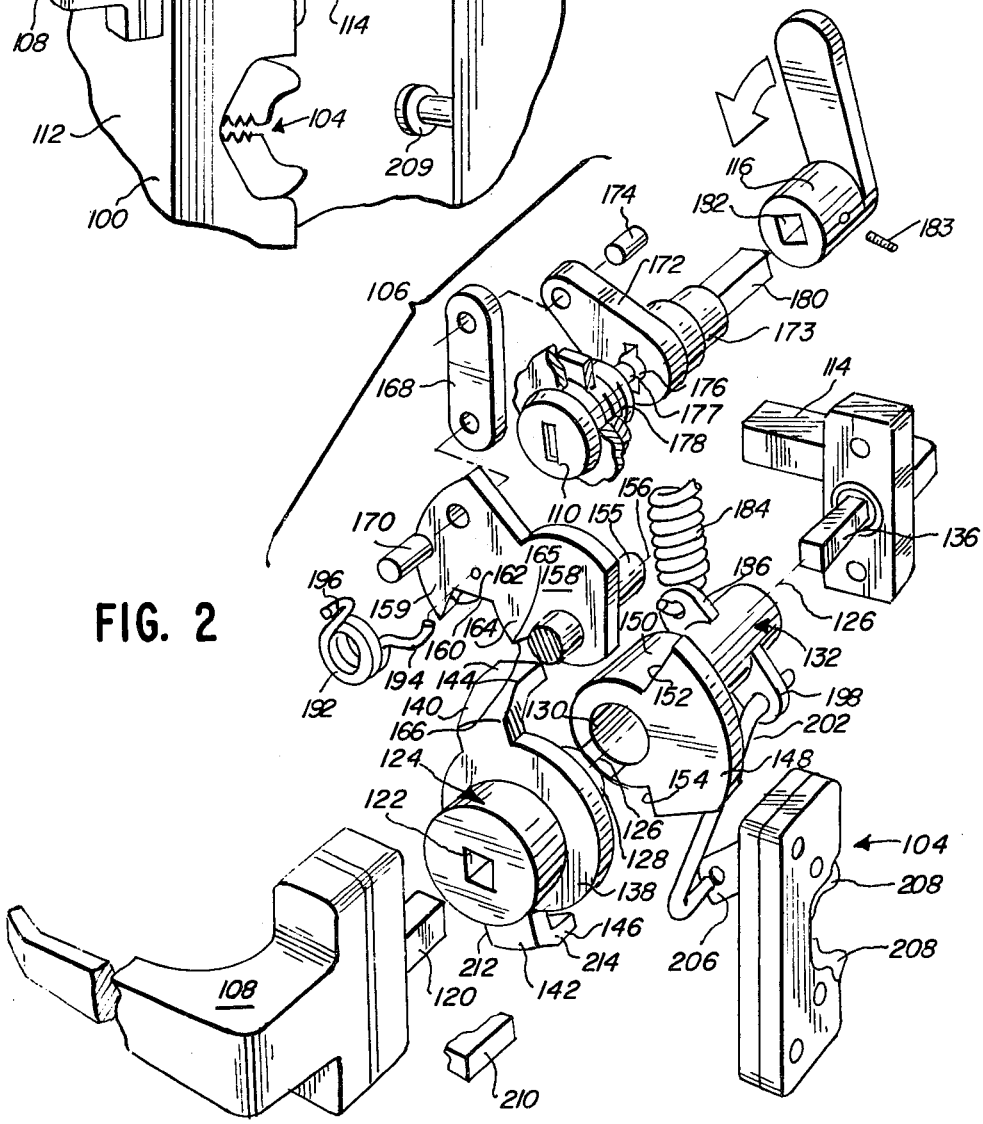
FIG. 2 is an exploded view of the lock mechanism.
Figure 3:
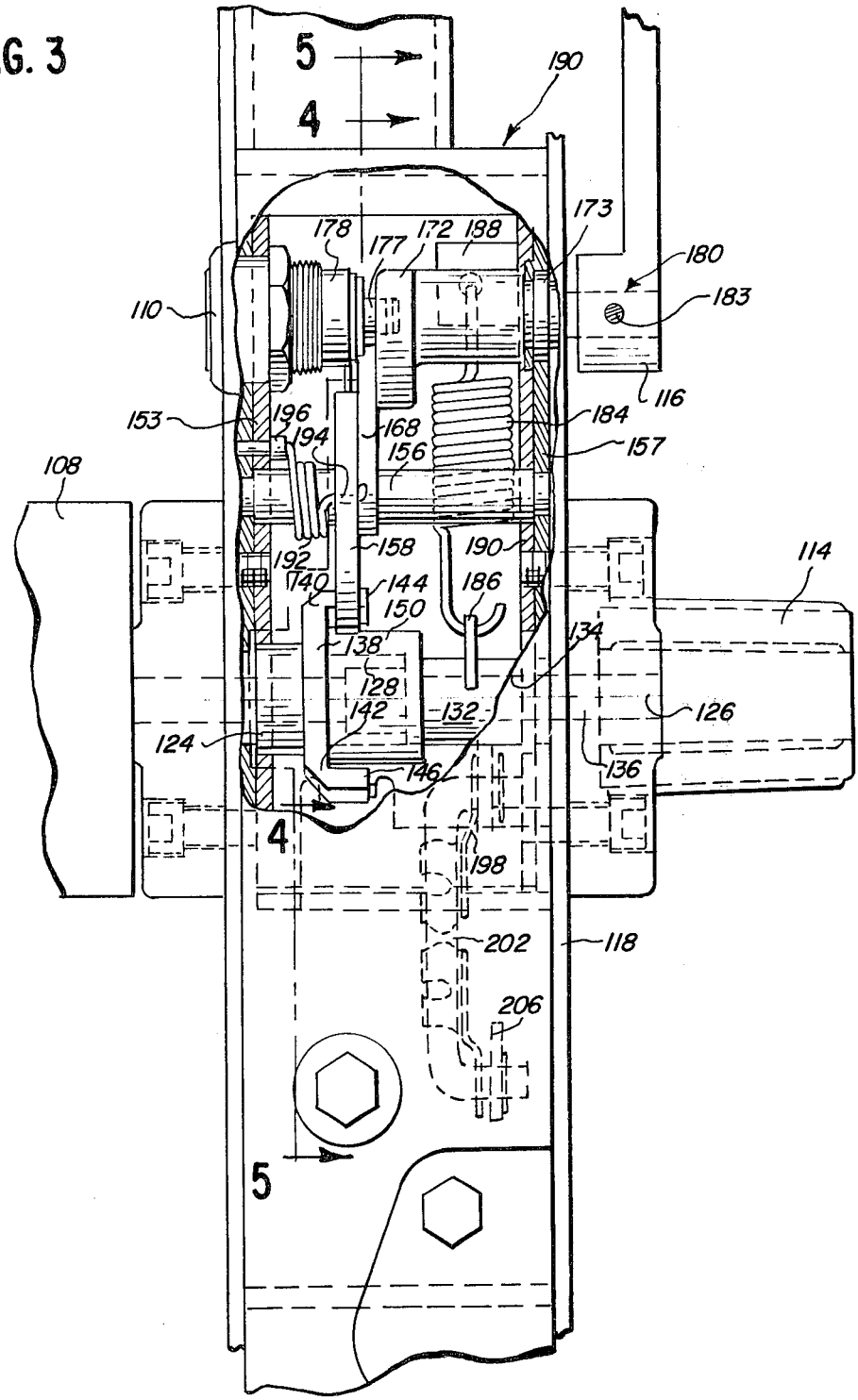
FIG. 3 is a side view of the lock mechanism with the housing partially broken away.

An exploded view of the door lock 106 showing the operational components of the lock 106 is shown in FIG. 2. The outside handle 108 has a square portion 120 which extends into a square aperture 122 in a lock ring 124 so that the outside handle 108 and lock ring 124 pivot together around a central axis 126. A cylindrical projection 128 extends from the rear of the lock ring 124 and is received in a matching cylindrical opening 130 in a bellcrank 132. The bellcrank 132 has a square aperture 134 (FIG. 3) in which is received a square portion 136 of the inside handle 114, ensuring that the bellcrank 132 and inside handle 114 rotate together around the central axis 126. The cylindrical projection 128 and opening 130 enable the bellcrank 132 and lock ring 124 to rotate relative to each other, thereby enabling the inside handle 114 and outside handle 108 to rotate relative to each other.

The lock ring 124 has a body portion 138 with two tabs 140,142 extending radially outward. Each tab 140,142 has an axially extending projection 144,146. When the bellcrank 132 and lock ring 124 are assembled together, the axially extending portions 144,146 of the tabs 140,142 overlap a body portion 150 of the bellcrank 132. Lying in the same plane as the axially extending portions 144,146 is an outwardly extending integrally formed segment of a collar 148 extending from the body portion 150 of the bellcrank 132. The collar 148 has at each end, abutments or contact surfaces 152,154, at least one of which surface 154 preferably lies along a radial axis passing through the central axis 126.

Figure 5:
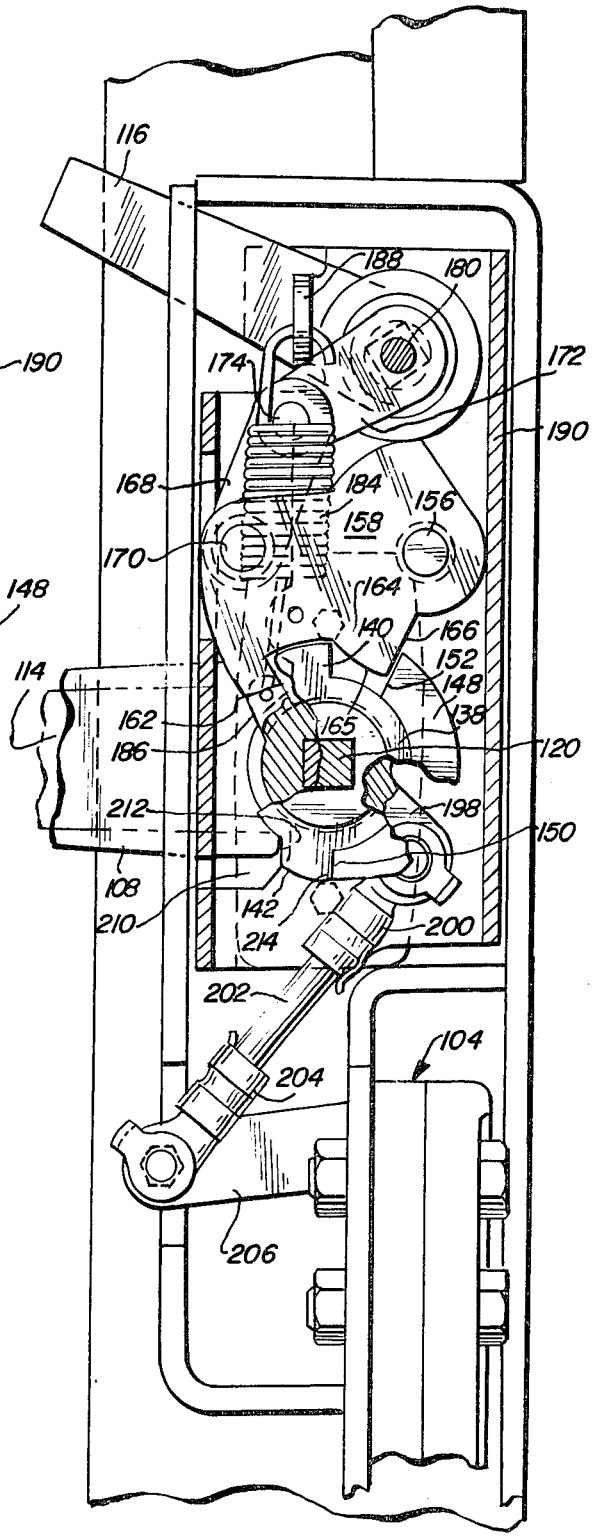
FIG. 5 is a plan view of the lock mechanism shown in conjunction with the door latch.

A locking cam 158 is affixed to a pivot shaft 155 which pivot shaft 155 is pivoted at each end in the housing sides 153,157 for pivotal movement about an axis 156 of the shaft 155. The shaft 155 is mounted in the housing and in an axially parallel relationship to the lock ring 124 and bellcrank 132. The locking cam 158 has a notch 160 for receiving the lock ring tab 140. The outer wall of the notch 160 is defined by a projection 159 having a locking surface 162 which is radially directed from the lock ring axis 126 when the locking cam 158 is in a locking position as shown in FIG. 5. The inner end of the notch 160 is defined by a cam section 164 having a cam surface 165 and a radially directed surface portion 166 which abuts one contact surface 152 of the latch ring collar 148 when the locking cam 158 is in the locked position.

The outer end of the locking cam 158 is pivotably connected by a rivet 170 to the lower end of a link 168 with the upper end of said link 168 being pivotably connected to another link 172 by a rivet 174. The latter link 172 has a butterfly opening 176 which receives a bar (not shown) mounted on a lock shaft 177 extending from the barrel 178 of the key lock 110. The key lock 110 is mounted to the side 153 of housing 190 and outer wall of the door above the location of the locking cam 158.

The upper link 172 also has a square shaft 180 extending through bushing 173 which then extends through the side 157 of the housing 190 and through the inner panel 118 of the door 100 which shaft 180 is received in a matching square aperture 182 in the lock handle 116, lock handle 116 is retained on shaft 180 by set screws 183, ensuring that the lock handle 116 and upper link 172 pivot together. Using the handle 116 and linkage 172,168 and locking cam 158 to lock the lock 106 from inside the cab, enables the entire lock mechanism to be sealed inside the door 100. Contrary to the prior art which required that a slot be provided in the door through which a lock lever extended, the improved arrangement requires only a hole in the door panel for the attachment of the handle 116 to shaft 180 which projects through the door panel opening and thus maintains the seal on the door lock 106. This seal keeps dirt and dust particles out of the lock mechanism and thus prevents the potentially deleterious effects which can result therefrom. The above is especially important in heavy equipment such as tractors and bulldozers which are usually operated in exceptionally dirty and dusty environments.

Two springs are included in the lock 106 to bias and hold the moving components in the desired positions. A tension spring 184 is mounted on one outwardly extending arm 186 on the bellcrank 132 and is mounted at the other end at a tab 188 (FIGS. 3,5) secured to the lock housing 190. The outwardly extending arm 186 is on the left side of the bellcrank 132 throughout the range of motion of the bellcrank 132 so that the tension spring 184 constantly biases the bellcrank 132 toward clockwise rotation as viewed from the outside (FIGS. 2 and 5).

A coil spring 192 has one leg 194 connected off-center to the locking cam 158 and has the other leg 196 connected to the lock housing 190. This spring 192 is arranged so that its extending butterfly legs 194, 196 are tensioned together to bias the locking cam 158 toward either its locked or unlocked position, the direction of the bias depending upon the location of the locking cam 158. The spring 192 changes its direction of bias on the locking cam 158 at the position where the point of connection of the leg 194 on the locking cam 158 lies on the plane defined by the locking cam axis 156 and the point of connection of the housing 190 to the other leg 196. This position is approximately halfway between the extreme positions for locking and unlocking.

There is a second arm 198 outwardly extending from the bellcrank 132 which is generally opposite the first outwardly extending arm 186. Pivotably connected to the second arm 198 is a spring clip 200, as is shown in FIG. 5, which receives an actuating rod 202 which may be of variable length depending on the placement of the lock 106 in relation to the latch 104. The actuating rod 202 is received at its lower end by a spring clip 204 which is pivotably connected to a lever arm 206 of a conventional latch 104. Movement of rod 202 by the bellcrank 132 moves the lever arm 206 to open the jaws 208 of the latch 104. The jaws 208 grasp the catch 209 on the cab door jamb 102 to latch the door 100 closed by way of the internal spring loaded jaws 208 and catch 209.

Also shown is a stop 210 which extends from the lock housing 190 and engages one contact face or side 212 of the lock ring tab 142 to limit clockwise rotation of the lock ring 124 and handle 108. Since one contact surface 154 of the collar 148 on the bellcrank 132 abuts the other side surface 214 of the tab 142, this stop 210 also limits clockwise rotation of the bellcrank 132 (as viewed from the outside of the door).

INDUSTRIAL APPLICABILITY

The lock 106 enables an operator within the equipment cap to manipulate the inside door latch handle 114 to unlatch the door 100 whether the lock 106 is locked or unlocked. The operator may also lock or unlock the lock 106 by manipulation of the lock handle 116. A person outside the equipment may use the exterior handle 108 to open the door 100 only when the lock 106 is unlocked. The door 100 may be unlocked from the outside only by insertion of the proper key within the key lock 110.

Operation of the exterior handle 108 is as follows. Since the exterior handle 108 pivots with the lock ring 124, the handle 108 will not turn when the locking cam 158 is in the locked position as shown in FIG. 5. That is, the locking surface 162 of the notch 160 in the locking cam 158 abuts the axially extending portion 144 of the upper tab 140 to prevent counterclockwise movement of the lock ring 124. The abutment of the axially extending portion 146 of the other tab 142 against the stop 210 prevents clockwise movement of the lock ring 124.

To open the lock 106 from the outside, a key may be inserted into the key lock 110 and turned clockwise. The clockwise turn of the key causes lock shaft 177 and bar (not shown) to turn within the butterfly opening 176, engaging the surfaces of that opening to pivot the link 172 clockwise which, in turn, causes the attached link 168 to pull on the locking cam 158 and pivot it clockwise toward its unlocked position. When the locking cam 158 is pivoted beyond its central position, the coil spring 192 further biases the locking cam 158 in the clockwise direction and, thus, holds the locking cam 158 in its unlocked position. To lock the mechanism from the outside, the key is inserted into the key lock 110 and turned counterclockwise, thereby moving the links 168,172 to pivot the locking cam 158 to its locked position.

Figure 4:
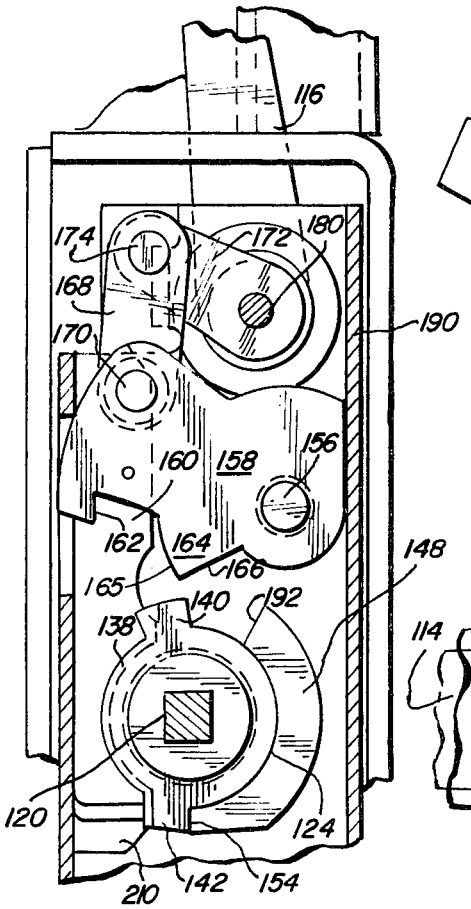
FIG. 4 is a plan view of the lock mechanism with the housing partially broken away, the lock mechanism being shown in the unlocking position.

When the locking cam 158 is in its unlocked position as shown in FIG. 4, the exterior handle may be pivoted downward (counterclockwise). This causes the lock ring 124 to pivot counterclockwise and, since the side surface 214 of the lower lock ring tab 142,146 engages one contact surface 154 on the latch ring collar 148, the bellcrank 132 pivots counterclockwise with the ring 124. This movement causes the second outwardly extending arm 198 on the bellcrank 132 to move upward, thereby pulling up on the actuating rod 202 and pivoting the lever arm 206 of the latch 104. Upward pivotal movement of the lever arm 206 opens the jaws 208 of the latch 104 around catch 209, thereby permitting the door 100 to be opened from the door jamb 102.

When this operation is completed and the outside handle 108 is released, the tension spring 184 moves the bellcrank 132 clockwise. Because of the abutting surfaces 154,214 between the latch ring collar 148 and the portion 146 of the lock ring tab 412, the bellcrank 132 is moved clockwise by the spring 184 until it returns to its original position abutting the stop 210.

The inside handle 114 operates the lock 106 as follows. By pushing downward on the inside handle 114 (counterclockwise as viewed from the outside), the bellcrank 132 is moved counterclockwise, raising the second outwardly extending arm 198 and pulling up on the actuating rod 202 to open the latch 104 by pivoting the lever arm 206 as heretofore described. This is freely done when the locking cam 158 is in the unlocked position.

The inside handle 114 may be pivoted downward to open the door latch 104 even if the locking cam 158 is in the locked position. When the inside handle 114 is biased downward, the leading contact surface 152 of the latch ring collar 148 engages the radially directed surface portion 166 of the cam section 164 of the locking cam 158. As the bellcrank 132 is turned farther, the leading contact surface 152 of the collar 148, particularly its outer end, pushes against the radially directed surface portion 166 of the cam section 164 of the locking cam 158 and pivots the locking cam 158 clockwise until the spring 192 snaps it into its unlocked position.

In order to move the locking cam 158 from its unlocked to its locked position from inside the cab, the lock handle 116 is pivoted in a counterclockwise direction as viewed from outside the cab. The handle 116 moves the links 172,168, and the locking cam 158 in a counterclockwise direction until the spring 192 snaps the locking cam 158 into the locked position on tab 140, a manner similar to that done by the key lock 110 from the outside.

Other aspects, objects and advantages of this invention can be obtained from a study of the drawings, the disclosure and the appended claims.

I claim:

1. A lock assembly for a latch structure (104) which latches a vehicle door (100), said lock assembly comprising:

a first handle (108);

a lock ring (124) affixed to said first handle (108);

spaced apart means (140,142) carried by said lock ring (124);

rigid stop means (210) extending into position to be contacted by one of said spaced apart means (142);

a second handle (114) extending in a direction opposite to said first handle (108);

a bellcrank (132) fixed to said second handle (114) and being coaxially aligned with said lock ring (124) and being rotatably mounted relative thereto;

an actuator rod (202) connecting said bellcrank (132) and said latch structure (104) for operating said latch structure (104);

locking means (158) mounted to prevent rotation of said lock ring (124) by engaging one of said spaced apart means (140), said locking means (158) being pivotable between a locked position and an unlocked position;

a key lock means (110) operably mounted on the outside of said vehicle;

means (168,172) connecting said locking means (158) to said key lock means (110); and a third handle (116) operable from inside said vehicle and connected to and coaxially aligned with said key lock means (110);

said third handle (116) and said key lock means (110) each being operable to pivot said locking means (158) into a locked or unlocked position on said lock ring (124).

2. The lock assembly of claim 1 wherein said means (168,172) connecting said locking means (158) to said key lock means (110) comprises a first link (168) pivotally connected to said locking means (158), a second link (172) pivotally connected to said first link (168) and fixedly connected to said third handle (116), rotation of said third handle in one direction moves said locking means (158) to the locked position and rotation of the third handle in the other direction moves said locking means (158) to the unlocked position.

3. The lock assembly of claim 1 wherein said locking means (158) has a cut out portion (160) for selectively engaging said one spaced apart means (140), and an overcenter spring means (192) connected between the vehicle door (100) and the locking means (158) for urging said locking means (158) either to a locked position or to an unlocked position.

4. The lock assembly of claim 1 wherein bellcrank (132) has an abutting surface (152) for engaging a cam section (164) of the locking means (158) when said bellcrank (132) is turned by said second handle (114) to rotate said locking means (158) to unlock the latch.

5. The lock assembly of claim 1 wherein said handles (108,114,116) extend through openings in the door (100)

to engage with their respective door lock components, and each of said handles (108,114,116) slidingly abut the door (100) around each of said openings to maintain a seal within said door (100).

6. A lock assembly for a door for a vehicle having a structure (106) for locking said door (100), comprising:

first and second handle means (108,114) extending outwardly and inwardly from opposite sides of said door (100);

a cam element (158) having one portion (162) engaging with the first of said handle means (108) for preventing said first handle means (108) from being turned when said cam element (158) is in the locked position;

a second portion (164) of said cam element (158) engaging with an abutment (152) on a rotatable link (132) when said cam element (158) is in said locked position, said rotatable link (132) moving said abutment (152) against said second portion (164) of the cam element (158) to simultaneously move the first portion (162) of the cam element (158) out of engagement with the first handle means (108) and to move the cam element (158) to the unlocked position;

means (202) for operatively connecting said rotatable link (132) to a latch means (104), both said first and second handle means (108,114) being operative to open said latch means (104) to unlatch said door (100) when said cam element (158) is in the unlocked position;

linkage means (168,172) for moving said cam element (158) between its locked and unlocked positions;

key lock means (110) for operating said linkage means (168,172);

third handle means (116) coaxially aligned with the key lock means (110) for overriding said key lock means (110) and operating said linkage means (168,172).

7. The lock assembly of claim 6 wherein said key lock means (110) and said third handle means (116) are coaxially aligned and extend outwardly and inwardly from opposite sides of said door (100).

8. The lock assembly of claim 7 wherein said linkage means (168,172) comprises:

a first link (168) pivotably connected at one end to said cam element (158); and a second link (172) pivotably connected to the other end of said first link (168), said second link (172) at its opposite end engaging said key lock means (110) and said third handle means (116) for being operatively pivoted around the common axis.

9. In a lock (106) and latch (104) structure for a vehicle door (100) having a first handle (108) with a lock ring (124) fixed thereon, spaced apart tabs (140,142) carried by said lock ring (124), rigid stop means (210) extending into position to be contacted by one of said spaced apart tabs (142), a second handle (114) extending in a direction opposite to said first handle (108) and having a bellcrank (132) fixed thereon, said bellcrank (132) being coaxially aligned with said lock ring (124) and being rotatably mounted relative thereto, an actuator rod (202) connecting said bellcrank (132) and said latch structure (104) to operate said latch structure (104), a pair of means (152,154) on said bellcrank (132) with one of said means (154) engaging with one of said spaced apart tabs (142) on said lock ring (124), locking means (158) pivotably mounted relative to said door (100), means (162) on said locking means (158) in alignment with one of said spaced apart tabs (140) on said lock ring (124) when said locking means (158) is in the locked position, second means (164) on said locking means (158) in contact with one of said means (152) on said bellcrank (132) when said locking means (158) is in the locked position, the improvement comprising:

a first link (168) pivotably secured to one end to said locking means (158);

a second link (172) connected to the other end of said first link (168), said second link (172) being pivotable around a point;

key lock means (110) engaging said second link (172) at its pivot point for pivoting said second link (172), said key lock means (110) projecting out of the door (100) on the same side as said first handle (108);

a third handle (116) coaxially aligned with and extending in a direction opposite to said key lock means (110) and operatively connected to said second link (172) for pivoting said second link (172);

wherein said second link (172) when pivoted moves said first link (168) so as to move said locking means (158) to either its locked or unlocked position.

10. The improvement of claim 8 wherein the three handles (108,114,116) substantially cover the respective openings in the door panel so as to seal the lock structure (106) within the door (100).

* * * * *